US007487889B2

(12) United States Patent
Owens

(10) Patent No.: US 7,487,889 B2
(45) Date of Patent: Feb. 10, 2009

(54) VARIABLY PROPORTIONAL MIXING DEVICE

(76) Inventor: James A. Owens, 827 S. Lincoln St., Hinsdale, IL (US) 60521

( * ) Notice: Subject to any disclaimer, the term of this patent is extended or adjusted under 35 U.S.C. 154(b) by 142 days.

(21) Appl. No.: 11/445,355

(22) Filed: Jun. 1, 2006

(65) Prior Publication Data

US 2006/0239115 A1 Oct. 26, 2006

Related U.S. Application Data

(63) Continuation-in-part of application No. 11/113,929, filed on Apr. 25, 2005.

(51) Int. Cl.
*B01F 15/04* (2006.01)

(52) U.S. Cl. ..... 222/144.5; 222/145.5; 222/145.7

(58) Field of Classification Search ..... 222/144.5, 222/145.1, 145.5–7, 55, 57, 135, 136; 366/160.1, 366/160.5

See application file for complete search history.

(56) References Cited

U.S. PATENT DOCUMENTS 4,971,118 A * 11/1990 Cluff ..... 141/103
5,033,519 A * 7/1991 Puffer et al. ..... 141/198
5,108,016 A * 4/1992 Waring ..... 222/468
6,537,246 B1 * 3/2003 Unger et al. ..... 604/82
6,571,989 B1 * 6/2003 Jiang ..... 222/145.7

* cited by examiner

*Primary Examiner*—J. Casimer Jacyna
(74) *Attorney, Agent, or Firm*—Grimes & Battersby, LLP; James F. McLaughlin

(57) ABSTRACT

A variably proportional mixing device is provided for automatically mixing two fluids stored in separate containers in various ratios without measuring, comprising a self-venting spout that attaches to an existing gas can or other container for storing a fluid having a threaded opening therein. The spout doses gas with oil at the specific ratio required by an engine manufacturer and is easily adjusted to accommodate a plurality of other ratios. To accomplish this, a constant volume of gasoline is dosed with an amount of oil that is adjusted by the user. This adjustment mechanism comprises a wheel valve having various-sized orifices. Twisting the valve using a knob or key then provides the correct volumetric area for the oil to flow through. Markings will be visible on the valve, through a window, that correspond to a plurality of different ratios, typically ranging from 16:1 to 50:1. The dosing valve can also be shut-off completely to allow pure gasoline through the spout, such as for 4 cycle engines. A spring-loaded button or trigger mechanism is incorporated to allow for a positive closure when not in use. Static mixing elements are added at the end of the spout to ensure a thorough mixture of oil and gas.

10 Claims, 6 Drawing Sheets

VARIABLY PROPORTIONAL MIXING DEVICE

RELATED APPLICATIONS

This is a continuation in part of co-pending U.S. patent application Ser. No. 11/113,929 filed on Apr. 25, 2005 in the name of James Owens for "Variably Proportional Mixing Container."

BACKGROUND OF THE INVENTION

1. Field of the Invention

The present invention relates generally to a variably proportional mixing device, and, more particularly, to such a variably proportional mixing device having two separate reservoirs for fluids such as oil and gasoline and a variably adjustable valve system that allows for the simultaneous pouring and mixing of the two fluids in a wide selection of ratios within the device or the spout thereof.

2. Description of the Prior Art

Systems for mixing two components in a predetermined ratio have long been known in the industry. A particular application of such systems relates to the admixture of two fluids, such as gasoline and oil, which mixture is necessary for the smooth operation of certain types of engines, such as two-cycle engines. Such engines are of the type that are frequently used for household equipment such as mowers, trimmers, blowers, edgers, snow blowers and chainsaws, as well as for recreational purposes, such as motorcycles, jet skis, snowmobiles and boats. Each type of engine may require a different ratio of gasoline to oil, which ratio must be maintained in order to prevent any damage from occurring to the engine and to extend the lifetime of such engine as long as possible.

In the typical system for mixing the fluids, a container is provided for each of the fluids, and a separate container may or may not be provided for the mixture. Since different engines require a different ratio of mixtures, the proper ratio must first be determined, and the appropriate amount of each fluid must then be measured out. Each fluid is then added to the separate container (or one fluid may be added to the other fluid's container) and the two fluids mixed together, such as by shaking. The mixed fluid may then be used in a particular application that requires such a fixed ratio.

The problems with such a system are numerous. First and foremost, only one pre-determined ratio may be mixed in the container at one time. Since many households have more than one two-cycle engine, multiple mixing containers are required to satisfy the various ratios demanded by these different engines. This system also tends to be unreliable, since it requires accurate measuring of each of the separate fluids. This system is also complicated and requires several different containers for mixing just one ratio. Furthermore, regardless of how much of the combined fluid is necessary, this system requires that a fixed amount of each fluid be used (e.g., a gallon of gasoline), often resulting in a tremendous amount of waste.

There are currently a number of such devices currently on the market, including the Gas Canplastic, the 2-Mixer and the Accu-Mix.

Examples of systems for mixing oil and gas in a predetermined ratio are also disclosed in the patent prior art. For example, in U.S. Pat. No. 6,250,154, which issued to Cheresko on Jun. 26, 2001 for "Oil and gas metering and measuring device," teaches a fluid metering and measuring device having a filling chamber with a fluid inlet and a fluid outlet with a plunger disposed within the chamber to create a vacuum in the chamber to cause a fluid, e.g. oil to flow into chamber and gradations to indicate the amount of oil drawn into the chamber to ensure proper fluid ratios.

The use of separate chambers for the fluids and a mixing zone is disclosed in U.S. Pat. No. 6,079,871, which issued to Jonas, et al. on Jun. 27, 2000 for "Method and device for combining at least two fluid media," which teaches a device having first and second fluid chambers connected to a flow region and mixing zone and at least one inlet opening for diverting part of the first fluid medium from the first chamber into the second chamber wherein the second chamber is provided with at least one opening into the flow region for discharging the second fluid medium displaced into it by the first fluid medium.

Other examples of containers for use in mixing two fluids, such as oil and gas, include U.S. Pat. No. 4,819,833, which issued to Huddleston, et al. on Apr. 11, 1989 for "Measuring, metering, and mixing can for gasoline and oil" discloses a measuring, metering, and mixing can including gasoline and containers and a plunger-cylinder metering unit for withdrawing a selected amount of oil from the oil container and injecting the same into the gasoline can for producing an oil-gasoline mixture. Similarly, U.S. Pat. No. 4,069,835, which issued to Stadler on Jan. 24, 1978 for "Fuel and lubricant mixer" discloses a device to proportionately mix fuel and lubricant having a cylindrical lubricant container, a columnar fuel delivery inlet which perpendicularly angles to merge with and to feed fuel into a conical funneled mixing chamber immediately below the base of the lubricant supply container, and an axially secured butterfly lever in the line of fuel inlet travel which is depressed by passing fuel to thereby activates a spring-loaded piston valve which allows a proportionate flow of lubricant to the mixing chamber.

Much of the prior art is not necessarily directed to the mixture of oil and gasoline, although it is clearly the intention that such systems and methods may be so used. For example, U.S. Pat. No. 5,406,995, which issued to Gantzer on Apr. 18, 1995 for "Container assembly for mixing liquids in predetermined ratios" discloses a container assembly having an outer container and at least one inner container whose internal volume has the same ratio to the remaining internal volume of the outer container as the desired ratio of liquids to be mixed wherein an orifice in the inner container establishes communication between the lower end portions of the two containers so that a previously mixed liquid mixture of a predetermined ratio resides at the same level in both containers. Similarly, U.S. Pat. No. 4,846,373, which issued to Penn, et al. on Jul. 11, 1989 for "Apparatus for proportioning or for proportioning and mixing plural different fluid compositions" discloses an apparatus for proportioning and dispensing at least two different fluids including a cartridge having separate chambers for containing separate fluid compositions to be proportioned and dispensed and a valve structure for controlling the flow of the fluid compositions through passageways, for preventing run-on of the fluid compositions through the respective passageways due to decompression of the fluid compositions upon removal of an extruding pressure, and thereby for preventing dispensing of the fluid compositions through the respective passageways in proportional ratios other than a desired predetermined proportional ratio.

A control valve particularly suitable for mechanical refrigeration systems is disclosed in U.S. Pat. No. 4,131,128, which issued to Gotzenberger on Dec. 26, 1978 for "Control Valve." This patent discloses a spherical valve operable by turning the valve body about an axis perpendicular to the direction of the fluid flow.

It should be appreciated that the mixing systems need not be limited to fluids. For example, U.S. Pat. No. 4,995,540, which issued to Colin, et al. on Feb. 26, 1991 for "Unit dosage dispenser for dental impression materials" discloses an apparatus for dispensing, in sequence, a unit dosage of several elastomeric impression materials of different viscosities so as to permit a dental impression to be taken under aseptic conditions in the preparation of a dental restoration.

Numerous other examples of mixing systems and methods are described in U.S. Pat. No. 6,736,536, which issued to Jacobs, et al. on May 18, 2004 for "Apparatus and method for measuring, mixing, and dispensing fluids"; U.S. Pat. No. 6,022,134, which issued to Andrews on Feb. 8, 2000 for "Mixing and dispensing container"; U.S. Pat. No. 5,662,249, which issued to Grosse on Sep. 2, 1997 for "All in one measure/funnel/pour/mix/shake container"; U.S. Pat. No. 5,447,245, which issued to Merhar on Sep. 5, 1995 for "Graduated proportioning and mixing container"; U.S. Pat. No. 5,375,742, which issued to Mowry on Dec. 27, 1994 for "Gas-oil mixture aid"; U.S. Pat. No. 5,295,610, which issued to Levison on Mar. 22, 1994 for "Mixing can having a hinged cap with an integral measuring cup"; U.S. Pat. No. 5,123,460, which issued to Reed on Jun. 23, 1992 for "Multi-purpose container system for loading liquid dispenser"; U.S. Pat. No. 5,108,016, which issued to Waring on Apr. 28, 1992 for "Fuel container system"; U.S. Pat. No. 4,860,927, which issued to Grinde on Aug. 29, 1989 for "Blow molded two-compartment container"; U.S. Pat. No. 4,779,993, which issued to Toole on Oct. 25, 1988 for "Oil and gasoline mixing device"; U.S. Pat. No. 4,721,393, which issued to Kwast on Jan. 26, 1988 for "Ratio Mix container"; U.S. Pat. No. 4,589,777, which issued to Soler on May 20, 1986 for "Mixing apparatus"; U.S. Pat. No. 4,480,470, which issued to Tussing on Nov. 6, 1984 for "Gas cap"; U.S. Pat. No. 4,294,273, which issued to Isberg on Oct. 13, 1981 for "Fluid proportioning device"; U.S. Pat. No. 4,292,846, which issued to Barnett on Oct. 6, 1981 for "Liquid proportioning container"; U.S. Pat. No. 4,185,653, which issued to Armstrong, et al. on Jan. 29, 1980 for "Liquid metering and mixing device"; U.S. Pat. No. 4,079,629, which issued to Hope on Mar. 21, 1978 "Oil to gasoline ratio measuring device"; U.S. Pat. No. 3,948,105, which issued to Johnson, Jr. on Apr. 6, 1976 for "Proportioning and mixing graduate"; U.S. Pat. No. 3,720,231, which issued to Ajero on Mar. 13, 1973 for "Add-on Oil-Fuel Metering Device"; U.S. Pat. No. 3,658,204, which issued to Bottger on Apr. 25, 1972 for "Set of Containers for Two Liquids"; U.S. Pat. No. 3,581,940, which issued to Cella on Jun. 1, 1971 for "Multiple compartment dispenser container with check valves"; and U.S. Pat. No. 2,986,162, which issued to Spexarth on May 30, 1961 for "Apparatus for providing a proper mixture of fuel and oil for an internal combustion engine."

As will be appreciated, none of these prior patents even address the problem faced by applicant let alone offer the solution proposed herein.

SUMMARY OF THE INVENTION

Against the foregoing background, it is a primary object of the present invention to provide a variably proportional mixing device including a single pre-mix device for combining and mixing two fluids in various ratios.

It is another object of the present invention to provide such a variably proportional mixing device that is easy to operate.

It is still another object of the present invention to provide such a variably proportional mixing device that allows for mixtures in various ratios to be poured without having to measure each component.

It is another object of the present invention to provide such a variably proportional mixing device that is consistent and reliable.

It is but another object of the present invention to provide such a variably proportional mixing device that combines and mixes the two fluids simultaneously.

It is yet still another object of the present invention to provide such a variably proportional mixing device that allows ratios to be changed instantly without having to exchange parts.

It is but another object of the present invention to provide such a variably proportional mixing device that may be globally accepted, regardless of the measuring units used for each component.

To the accomplishments of the foregoing objects and advantages, the present invention, in brief summary, comprises a variably proportional mixing device for automatically mixing two fluids stored in separate containers. The device comprises a self-venting spout that attaches to a gas can or other container for storing a fluid having a threaded opening therein. The spout doses gas with oil at the specific ratio required by an engine manufacturer and is easily adjusted to accommodate a plurality of other ratios. To accomplish this, a constant volume of gasoline is dosed with an amount of oil that is adjusted by the user. This adjustment mechanism comprises a wheel valve having various-sized orifices. Twisting the valve using a knob or key then provides the correct volumetric area for the oil to flow through. Markings will be visible on the valve, through a window, that correspond to a plurality of different ratios, typically ranging from 16:1 to 50:1. The dosing valve can also be shut-off completely to allow pure gasoline through the spout, such as for 4 cycle engines. A spring-loaded button or trigger mechanism is incorporated to allow for a positive closure when not in use. Static mixing elements are added at the end of the spout to ensure a thorough mixture of oil and gas. Means to allow users to record their specific ratios for easy reference may also be incorporated. A sight-glass is also provided to view availability of oil.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1:
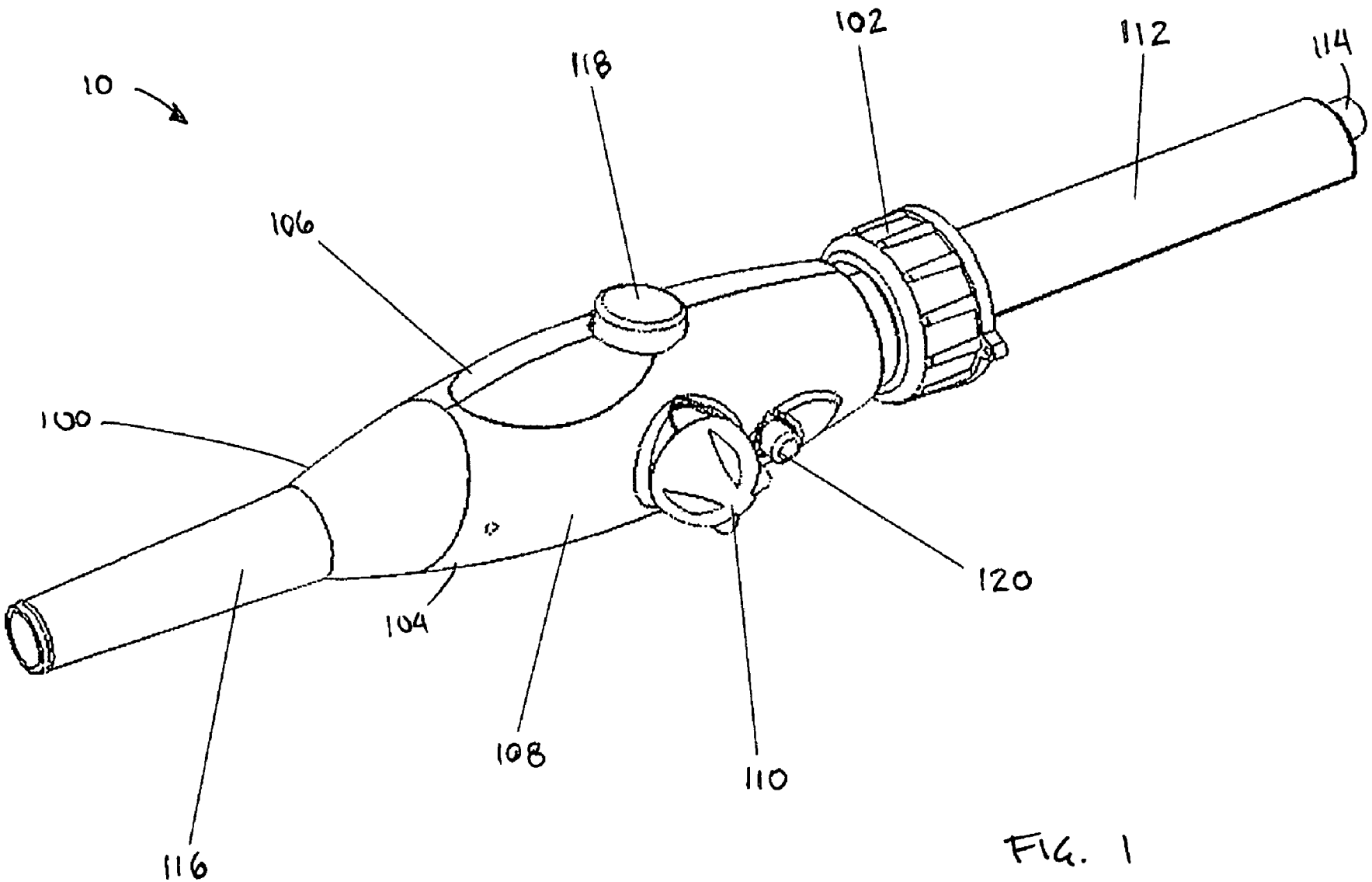
FIG. 1 is a front perspective view of the variably proportional mixing device of the present invention.

Referring to the drawings and, in particular, to FIG. 1 thereof, the variably proportional mixing device of the present invention, referred to generally by reference numeral 10, is illustrated. The system comprises a dosing apparatus 100 which may be attached directly to a gas canister or other container for the storage of a fluid such as fuel by means of an adapter ring 102 which engages the threads on the gas canister.

In the preferred embodiment, the dosing apparatus 100 includes a housing 104, preferably molded out of two halves—a right housing half 106 and a left housing half 108—which housing 104 contains the mechanism which allows the fluids to be mixed in a proportion selected by a user using ratio adjustment knob 110.

Oil, or the second fluid to be mixed, is stored in the water-tight oil reservoir 112, access to which is provided by screw cap 114. The screw cap 114 may be easily removed to pour oil into the reservoir 112 and then re-attached to provide a water-tight seal.

The oil-gas mixture is dispensed by means of a nozzle 116. Flow of the oil-gas mixture through the dosing apparatus 100 may be cut off by means of shutoff button 118. A sight glass 120 is provided within the housing 104 to ensure the flow of oil or the second fluid, since such flow may not be readily apparent when the mixing device is attached to a gas canister.

Figure 2:
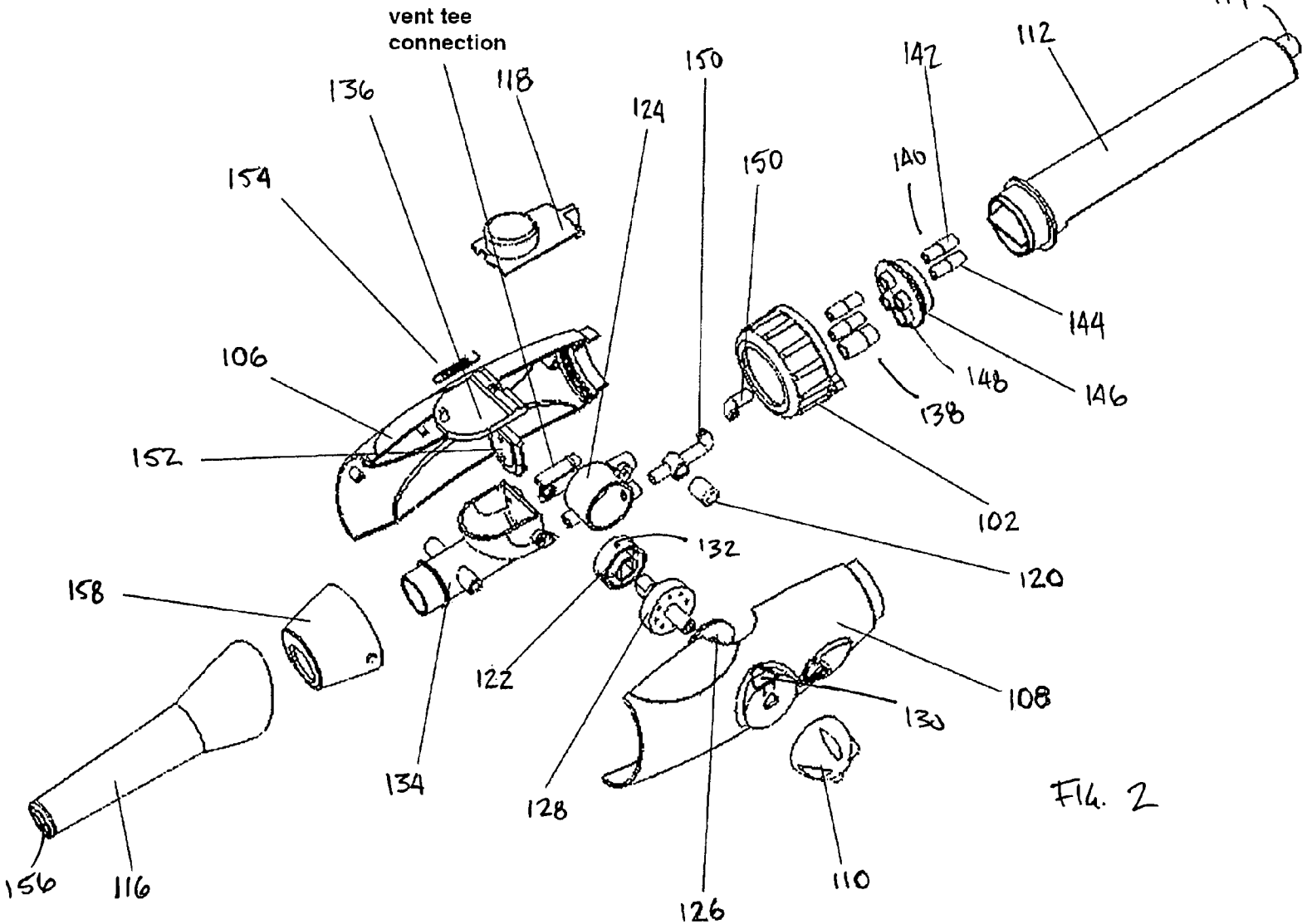
FIG. 2 is an exploded perspective view of the variably proportional mixing device of FIG. 1.
Figure 3:
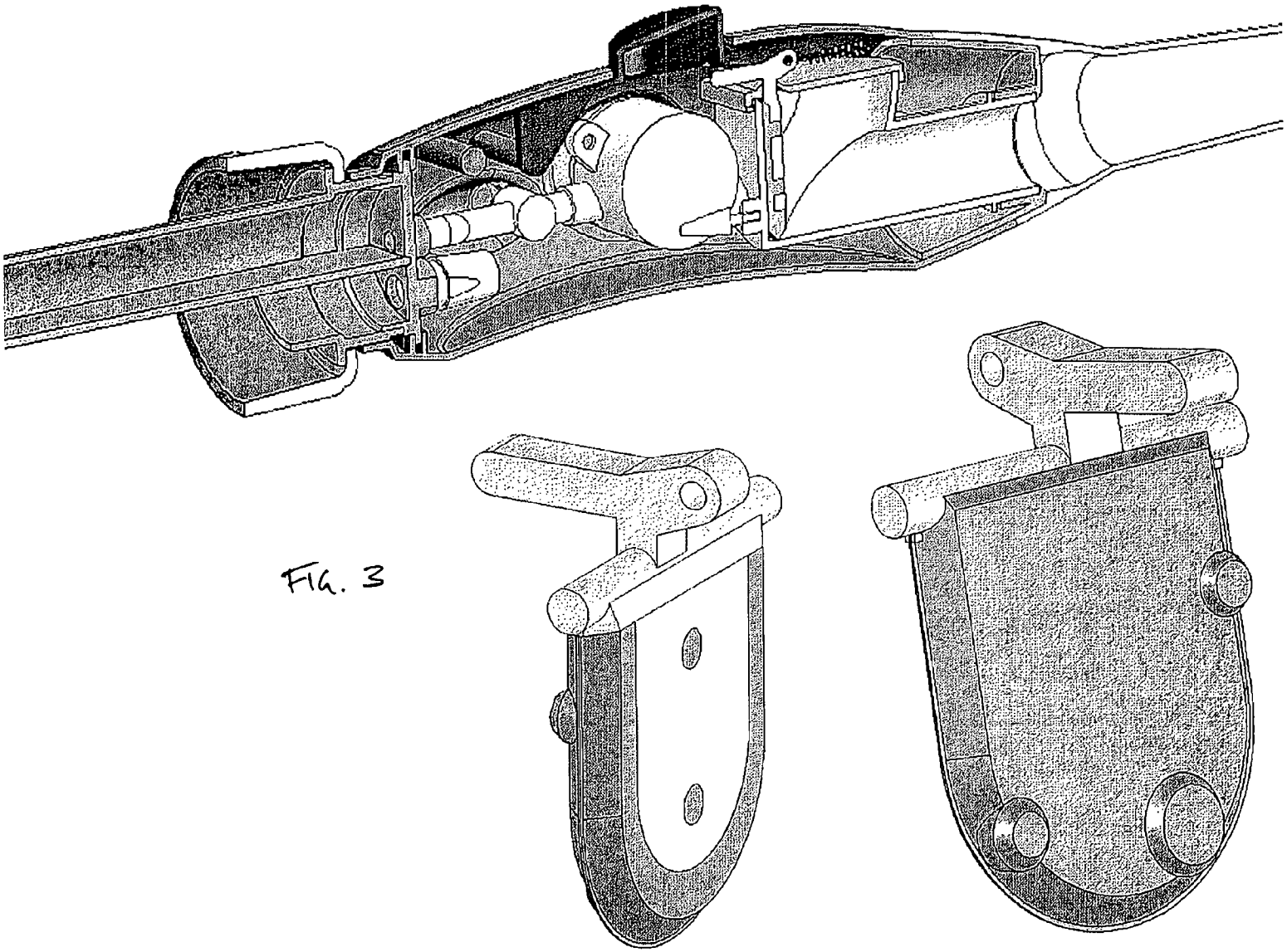
FIG. 3 is a cross-sectional perspective view of the variably proportional mixing device of FIG. 1.
Figure 4:
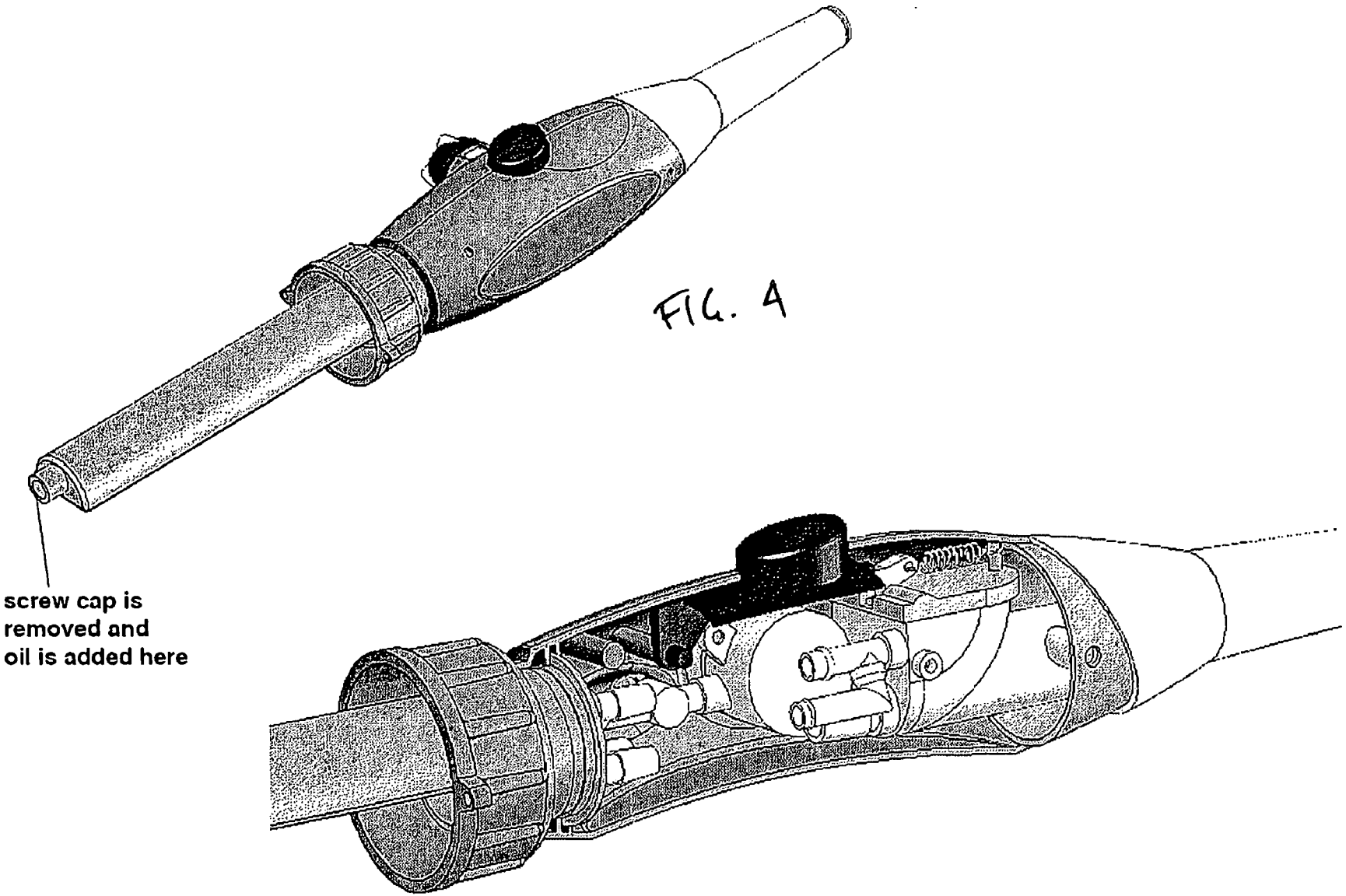
FIG. 4 is a rear perspective view of the variably proportional mixing device of FIG. 1.

Illustrated in FIGS. 2 and 3 are the internal components of the mixing device 10 which allow for the variably proportional mixing of the two fluids. The ratio of the fluids to be mixed from the gas canister and the oil reservoir 112 is controlled by ratio adjustment knob 110 disposed on the outside of the housing 104. The ratio adjustment knob 110 controls the flow of the fluid from the oil reservoir 112 by means of the oil regulator 122, which element is housed within oil regulator housing 124. It should be appreciated that while these particular elements may be referred to as oil reservoir 112 and oil regulator 122 because in the preferred embodiment the oil reservoir 112 is an oil canister, such nomenclature is for convenience sake only since the "oil reservoir" 112 could hold any substance, such as a pesticide or a food ingredient for example. Similarly, other structures and/or elements that are prefixed with the word "oil," "gas" or "fuel" are similarly done for convenience purpose only, and should not be construed to limit or otherwise dictate what fluids or substances may be used in this device.

The oil regulator 122 is fitted within the housing 104 so as to allow it to rotate freely, which rotation is controlled by the ratio adjustment knob 110. In order to prevent any oil from leaking into or otherwise escaping from the oil regulator housing 124, a housing end cap 126 is provided to create a water-tight (or oil-tight as appropriate) chamber within the oil regulator housing 124. The predetermined mix ratio for the various settings on the oil regulator 122 are shown on the ratio dial 128. In the preferred embodiment, the housing end cap 126 may be transparent to allow viewing of the particular selected ratio on the ratio dial 128 through a viewing window 130.

Figure 5:
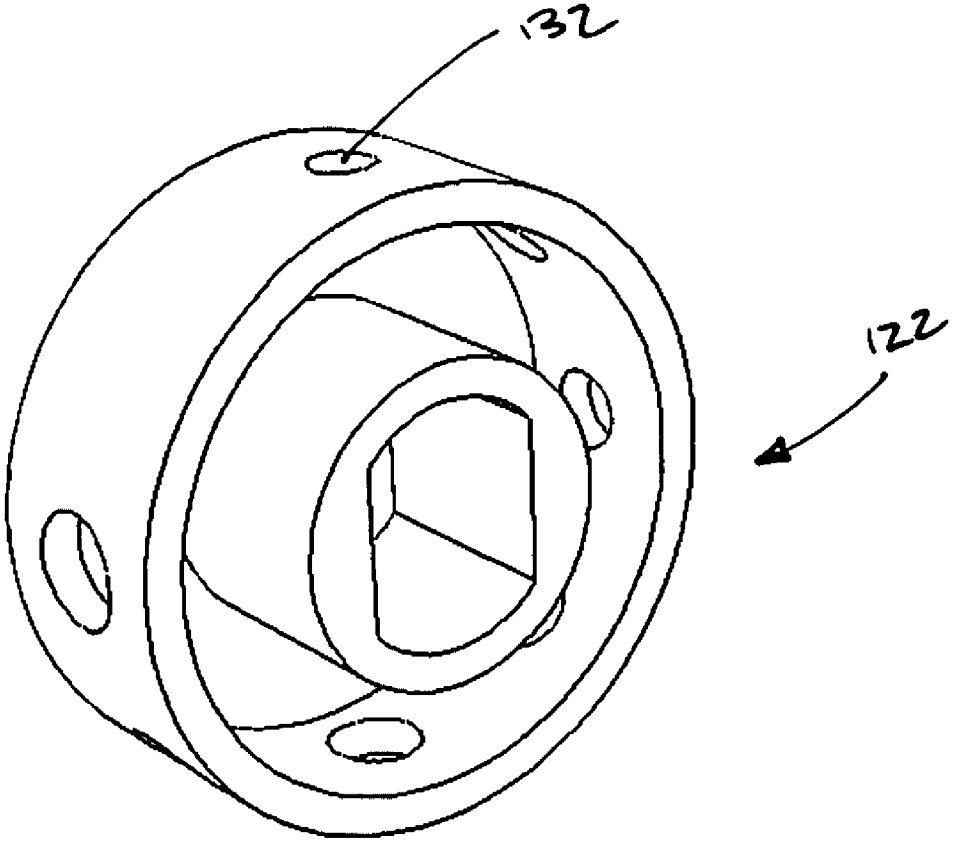
FIG. 5 is a front perspective view of the oil regulator of the variably proportional mixing device of FIG. 1.

Oil regulator 122 is essentially a wheel valve having various sized orifices 132 so as to allow differing volumes of oil to pass therethrough, which differing volumes of oil are mixed with gasoline from the gas canister in mixing chamber 134 in different predetermined ratios—for example, the ratios could range from 16:1 to 50:1, although other ratios are contemplated. The oil regulator 122 and various orifices 132 are shown in FIG. 5. By turning the ratio adjustment knob 110 to a desired ratio as visible in the window 130, the oil regulator 122 is rotated to the appropriate position, thereby providing an orifice 132 with the appropriate cross-sectional area to allow the proper volume of oil to flow therethrough to be mixed with the fuel in the mixing chamber 134 in the predetermined ratio. The ratio adjustment knob 110 may include an "off" setting allowing no oil to flow into the mixing chamber 134. A mixing chamber cap 136 may also be provided to close off the mixing chamber and prevent leakage.

The benefits of using a oil regulator 122 having a plurality of variably shaped orifices are numerous, including the fact that such part is easy to manufacture and replace, and can include any number of fixed, predetermined settings guided by clicks that allow for extremely accurate measurements.

Fluid is directed through the apparatus 100 by means of tubing system 138, and venting is provided by various vents 140, including the oil vent hose barb 142 and gas vent hose barb 144. The latter two vents 140 are disposed between the oil reservoir 112 and the reservoir cap 146. Tubing 138 is provided to the various apertures 148 in the reservoir cap 146 for venting and for fluid flow. Specifically, oil connectors 150 connect the oil reservoir 112 directly to the oil regulator housing 124 to allow passage of oil from the former to the latter. The tubing 138 serves as the transition element between the reservoir cap 126 and the mixing chamber 134. Gas is allowed to pass directly from the gas canister through one of the apertures 148 in the reservoir cap 146 and into the interior of the housing 104 and into the mixing chamber 134 where it mixes with oil in the ratio determined by the oil regulator 122.

Figure 6:
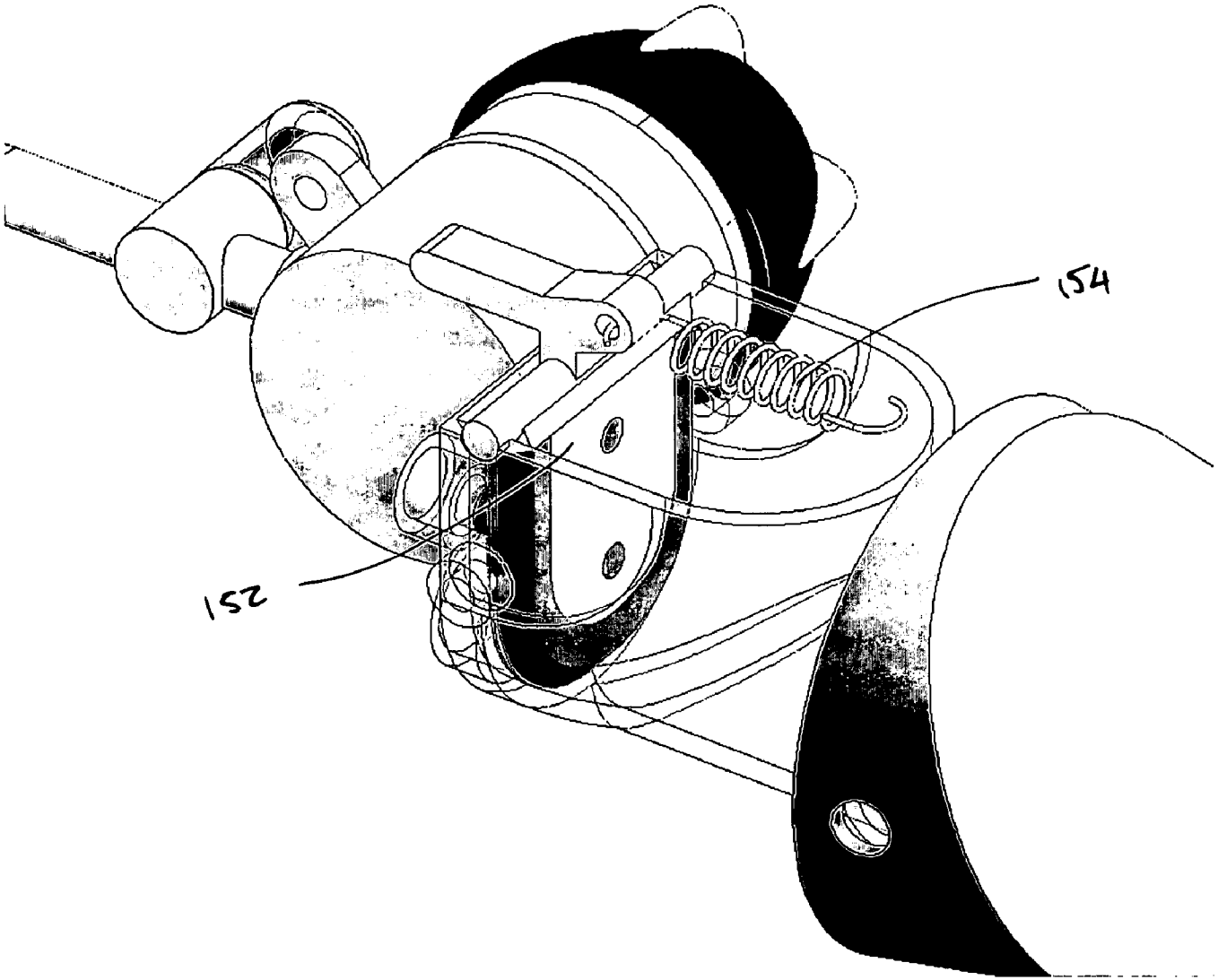
FIG. 6 is a front perspective view of the flapper valve of the variably proportional mixing device of FIG. 1.

A flapper valve 152 is provided to prevent fluid from flowing through the dosing apparatus, which flapper valve is operated by the shutoff button 118. Unless the shutoff button 118 is depressed, flapper valve 152 covers the mixing chamber 134, prevent any fluid from passing therethrough. By depressing the shutoff button 118, the flapper valve 152 is opened, thereby allowing fluid to pass. Flapper valve 152 and shutoff button 118 are held in the "closed" position by return spring 154 providing an air-tight seal. The relationship of the flapper valve 152, return spring 154 and mixing chamber 134 is shown in FIG. 6.

Nozzle 116 is provided to direct the flow of the fuel-oil admixture and to assist the mixing of the components thereof. The nozzle 116 may include one or more static mixers 156 to assist in the mixing of the oil and fuel. The static mixers 156 comprise structures that interrupt the flow of the fluid and induce turbulence within the fluid to thereby effectively mix the component elements. The nozzle 116 is connected to the main housing by means of nozzle insert 158. The nozzle insert 158 also provides a means to transition between the mixing chamber 134 and the nozzle 116.

The operation of the dosing apparatus 100 is a relatively simple endeavor. Screw cap 114 is unscrewed from the oil reservoir 112 and oil is poured into the reservoir 112. Flow of oil through the apparatus 100 is prevented by either the ratio adjustment knob 110 being turned to the "off" position or by the closed flapper valve 152. The screw cap 114 is then screwed back onto the oil reservoir 112 to prevent any oil from leaking or pouring out, potentially into the gas canister.

The dosing apparatus 100 is dropped into a gas can and screwed onto the gas canister using the adapter ring 102. Gas is allowed to flow into the dosing apparatus 100, but is prevented from flowing through the dosing apparatus entirely 100 by means of the flapper valve 152.

A user then selects a particular oil-fuel ratio by turning the ratio adjustment knob 110, which rotates the oil regulator 122 to the appropriate position, thereby allowing oil to pass through the appropriate orifice 132. The flow of oil through the oil regulator 122 is limited by the size of the orifice 132.

By depressing or squeezing the shutoff button 118, the flapper valve 152 opens, thereby allowing the oil and gas to pass from their respective reservoirs into the mixing chamber 134 in the appropriate ratio determined by the oil regulator

122. Mixing is completed as the fuel and oil pass the static mixers 156 which serve to disturb the flow of fluid and create turbulence within the flow.

Having thus described the invention with particular reference to the preferred forms thereof, it will be obvious that various changes and modifications can be made therein without departing from the spirit and scope of the present invention as defined by the appended claims.

I claim:

1. A device for automatically mixing a first and a second fluid in one of an operator selectable ratios, the first fluid being stored in a first container, the second fluid being stored in a second container, said device comprising:

a main body housing further comprising a manually operated fluid flow regulator for said second fluid, a mixing chamber and an output nozzle;

said mixing chamber receiving a first fluid input from a first fluid conduit providing fluid communication between said first container and said mixing chamber;

said mixing chamber receiving a second fluid input from a second fluid conduit providing fluid communication between a regulator output port of said regulator and said mixing chamber;

said fluid inputs gated by a single valve for opening and closing said fluid communication simultaneously between said conduits and said mixing chamber;

said mixing chamber having an output port in fluid communication with said output nozzle;

said regulator further having an input port in fluid communication with said second container; and said fluids propelled solely by the force of gravity;

whereby upon the opening of said single valve said fluids flow from each respective container to the mixing chamber, said manual regulator controlling the flow of the second fluid in a predetermined manner so that the resultant mixture in the mixing chamber is in accordance with an operator selected ratio, and such predetermined ratio of fluids exits said device through said nozzle.

2. The device of claim 1, in which the single valve comprises a flapper valve.

3. The device of claim 2, in which said main housing further comprises a single fluid coupling port for receiving said first and second fluids simultaneous from said respective first and second containers;

said port having a first orifice for fluidly coupling exclusively with said first container and having a second orifice for fluidly coupling exclusively with said second container; and said second container being wholly enclosed inside of said first container.

4. The device of claim 3, further comprising a ratio adjustment selector mounted on an external surface of said main body; and said selector is mechanically coupled to said fluid regulator.

5. The device of claim 4, wherein said regulator includes a plurality of orifices selectable by rotating said regulator using said ratio adjustment selector.

6. The device of claim 5, wherein said regulator is housed within a water-tight regulator housing.

7. The device of claim 6, further including an operator shutoff button mechanically connected to said valve and further biased by a spring in said valve closed position;

whereby said first and second fluids are prevented from escaping from said device when said shutoff button is manually released.

8. The device of claim 7, wherein said ratio cylinder includes venting means.

9. The device of claim 8, further including at least one venting tube.

10. The device of claim 9, further comprising at least one static mixer disposed within said nozzle.

* * * * *